US010443157B2

(12) United States Patent
Bauer et al.

(10) Patent No.: US 10,443,157 B2
(45) Date of Patent: Oct. 15, 2019

(54) MACHINE AND METHOD FOR THE PRODUCTION OF KNITTED GOODS

(71) Applicant: SIPRA Patententwicklungs—und Beteiligungsgesellschaft mbH, Albstadt (DE)

(72) Inventors: Wolfgang Bauer, Kornwestheim (DE); Bernd Boss, Albstadt (DE); Thomas Dziadosz, Balingen (DE); Axel Flad, Burladingen (DE); Sabine Beck, Albstadt (DE); Christine Maier, Albstadt (DE); Manuel Schwab, Kusterdingen (DE); Josef Vennemann, Hausen ob Verena (DE)

(73) Assignee: SIPRA Patententwicklungs—und Beteiligungsgesellschaft mbH, Albstadt (DE)

( * ) Notice: Subject to any disclaimer, the term of this patent is extended or adjusted under 35 U.S.C. 154(b) by 254 days.

(21) Appl. No.: 15/532,223

(22) PCT Filed: Nov. 11, 2015

(86) PCT No.: PCT/EP2015/076334
§ 371 (c)(1),
(2) Date: Jun. 1, 2017

(87) PCT Pub. No.: WO2016/091521
PCT Pub. Date: Jun. 16, 2016

(65) Prior Publication Data

US 2017/0283992 A1 Oct. 5, 2017

(30) Foreign Application Priority Data

Dec. 11, 2014 (EP) ..... 14197425

(51) Int. Cl.
*D01H 1/14* (2006.01)
*D01H 5/74* (2006.01)
(Continued)

(52) U.S. Cl.
CPC ..... *D01H 1/14* (2013.01); *D01H 5/74* (2013.01); *D04B 1/12* (2013.01); *D04B 9/14* (2013.01); *D04B 35/22* (2013.01)

(58) Field of Classification Search
CPC ... D01H 1/14; D01H 5/70; D01H 5/74; D04B 1/10; D04B 1/12; D04B 9/14; D04B 35/22
See application file for complete search history.

(56) References Cited

U.S. PATENT DOCUMENTS 3,099,048 A * 7/1963 Locher ..... D01H 5/42 19/240
3,952,372 A * 4/1976 Howell, Jr. ..... D01H 5/18 19/243
(Continued)

FOREIGN PATENT DOCUMENTS

CN 101122060 A 2/2008
CN 2009091683 A 4/2009
(Continued)

OTHER PUBLICATIONS

Chinese Office Action dated Oct. 29, 2018 in Chinese Application No. 201580067037.9 with English translation of the relevant parts.
(Continued)

*Primary Examiner* — Ismael Izaguirre
(74) *Attorney, Agent, or Firm* — Collard & Roe, P.C.

(57) ABSTRACT

A machine for the production of knitted goods includes a plurality of stitch-forming elements, at least one stitch-forming location, an associated spinning device at the at least one stitch-forming location, at which a sliver (FB) or
(Continued)

a yarn is produced from a roving yarn (VG) and the sliver (FB) or yarn is fed to the stitch-forming elements. The spinning device has separate drive devices, which can be actuated in a manner that enables the spinning device to produce a sliver (FB) or a yarn of variable thickness from roving yarn (VG) and which can be fed to the stitch-forming elements.

23 Claims, 7 Drawing Sheets

(51) Int. Cl.

| | |
|---|---|
| ***D04B 1/12*** | (2006.01) |
| ***D04B 9/14*** | (2006.01) |
| ***D04B 35/22*** | (2006.01) |

(56) References Cited

U.S. PATENT DOCUMENTS

| | | | | |
|---|---|---|---|---|
| 4,389,364 | A * | 6/1983 | Endo | D01D 5/20 264/167 |
| 4,574,018 | A * | 3/1986 | Masuda | D04H 11/00 156/155 |
| 6,671,936 | B1 * | 1/2004 | Carlson | B32B 5/26 28/104 |
| 7,503,190 | B1 | 3/2009 | Knight, Sr. et al. | |
| 9,328,438 | B2 | 5/2016 | Koenig | |

FOREIGN PATENT DOCUMENTS

| | | | |
|---|---|---|---|
| CN | 103014931 | A | 4/2013 |
| CN | 202925258 | U | 5/2013 |
| CN | 103917707 | A | 7/2014 |
| DE | 10305793 | A1 * | 8/2004 |
| DE | 10 2005 052 693 | | 5/2007 |
| DE | 10 2006 037 714 | | 2/2008 |
| EP | 94432 | A2 * | 7/1992 |
| JP | 02210001 | A * | 8/1990 |
| WO | WO 2004/079068 | | 9/2004 |
| WO | 2008017340 | A1 | 2/2008 |
| WO | WO 2009/026734 | | 3/2009 |
| WO | WO 2009/059438 | | 5/2009 |
| WO | WO 2013/041220 | | 3/2013 |

OTHER PUBLICATIONS

Taiwanese Office Action with Search Report dated Mar. 15, 2019 in Taiwanese Application No. 104140140 with English translation of the relevant parts.

English Translation of International Preliminary Report on Patentability for PCT/EP2015/076334 dated Jun. 13, 2017.

* cited by examiner

MACHINE AND METHOD FOR THE PRODUCTION OF KNITTED GOODS

CROSS-REFERENCE TO A RELATED APPLICATION

The invention described and claimed hereinbelow is a National Stage Application of PCT/EP2015/076334, filed on Nov. 11, 2015 (the PCT application), now filed in the United States under 35 USC § 371. The PCT application claims priority from European Patent Application EP 14197425.3, filed on Dec. 11, 2014. The contents of the PCT application and the European Patent Application are incorporated by reference herein. The PCT application provides the basis for a claim for priority of invention.

BACKGROUND OF THE INVENTION

The invention relates to a machine for the production of knitted goods with a plurality of stitch-forming elements and with at least one stitch-forming location, which has an associated spinning device, which from a roving yarn produces a sliver or a yarn and respectively feeds this to multiple stitch-forming elements, a method for the production of knitted goods and also knitted goods produced according to the method.

Knitting machines, in particular circular knitting machines, in which a sliver or a yarn that is produced from a roving yarn directly by the knitting systems of spinning devices associated with the knitting machine is fed to the knitting needles, have already been known for some time. Thus, WO 2004/079068 A2 describes a knitting machine, in which drafting devices draw a roving yarn to a sliver of desired fineness and feed this directly to the knitting needles. The knitted goods produced from such a sliver are distinguished by their extreme softness and very pleasant feel. It was further proposed in this publication to respectively produce a conventional or non-conventional yarn by means of spinning devices on the machine and to feed this to the knitting needles, if knitted goods with a slightly higher stability are to be produced.

A knitting machine with drafting devices, the bottom rollers of which are motor-driven, wherein the motors of multiple drafting devices are respectively associated with a common frequency converter and are also actuated by the control device of the knitting machine, is known from DE 10 2005 052 693 A1. A change in the thickness of the sliver can only be made for multiple knitting locations simultaneously here, as a result of which the patterning possibilities of this known machine are greatly restricted.

WO 2009/026734 A1 describes a compact drafting device for knitting machines, in which the apron rollers and a withdrawal roller pair are driven by separate motors. The apron rollers are coupled to a feed roller pair for drive purposes. However, control techniques have thus far enabled knitting machines that are equipped with these drafting devices to produce only horizontal stripe patterns by generating slivers or yarns of different thickness, and not patterns in which the sliver or yarn thickness changes within a stitch row when all the drafting devices draw the same roving yarn. This was previously only possible when roving yarns of different thickness are fed to the individual drafting devices. However, when changing to a different pattern the roving yarn bobbins then have to be exchanged on the machine, which is very complex.

OBJECTS AND SUMMARY OF THE INVENTION

Working from this prior art this invention is based on the object of enabling the efficient production of knitted goods with any desired patterns consisting of stitches formed from slivers or yarns of different thickness.

The object is achieved by a machine for the production of knitted goods with a plurality of stitch-forming elements and with at least one stitch-forming location, which has an associated spinning device, which from a roving yarn produces a sliver or a yarn and feeds this to multiple stitch-forming elements, which is characterised in that the spinning device has drive devices, which can be actuated in such a manner that with the spinning device a sliver or a yarn of variable thickness can be produced from the roving yarn and can be fed to the stitch-forming elements.

When using the same roving yarn, the machine according to the invention also enables a sliver or yarn of different thickness to be fed to each stitch-forming element and formed into stitches by the stitch-forming elements. As a result, it is possible to generate knitted goods with a pattern, in which the thickness of the yarn or sliver also varies in stitch row direction. In this case, a flyer frame sliver, a card sliver or a drawing sliver can be used as roving.

It is, of course, also possible in this case to provide at least two stitch-forming locations, to which spinning devices are assigned, wherein the thickness of the sliver or yarn produced by an adjacent spinning device can be different.

Each spinning device can preferably have its own drive device. However, it is also possible to couple multiple spinning devices by gearing, the transmission ratio of which is adjustable, and provide a common drive device for these spinning devices.

In this case, the drive devices of the spinning devices can be actuated in such a manner that the thickness of the sliver or yarn varies between the stitch-forming elements supplied by the same spinning device. Therefore, even patterns in which the sliver or yarn thickness varies from stitch to stitch within a stitch row can be produced.

In an extreme case, the drive devices of the spinning devices can even be actuated in such a manner that the thickness of the produced and supplied sliver or yarn is different in all the stitch-forming elements supplied by the same spinning device.

In this case, a spinning device can supply a single stitch-forming location or also multiple stitch-forming locations with sliver.

As a result, there is hardly any limit in the pattern variety that can be achieved with a machine according to the invention by varying the sliver or yarn thickness. It is naturally also possible in this case to implement further measures such as feeding special yarns, varying the parameters at the withdrawal of the stitch-forming elements, changing the drawing for generating stitches of different size and also selecting stitch-forming elements in order to obtain the desired pattern and a knitted product in the desired quality.

In a first preferred configuration of the machine the spinning devices can have drafting devices with multiple roller pairs, wherein at least two of the roller pairs have their own drive device and these drive devices can be actuated independently of one another. The greater the difference in speeds of the two roller pairs, the higher the drawing speed becomes and therefore the thinner the generated sliver. This can either be fed directly to the stitch-forming elements or be spun into a yarn beforehand by a spinning element.

In another configuration of the machine the spinning devices can have friction spinning devices with at least one feed roller, the speed of which is adjustable in relation to a delivery roller pair. Here, the thickness of the generated yarn determines the ratio of the circumferential speed of the feed roller to the speed of delivery.

With a larger spacing between the stitch-forming locations and the spinning devices it is advantageous if transport devices for the sliver or the yarn are provided between the spinning devices and the stitch-forming locations. With such transport devices, which, for example, can comprise transport rollers and/or transport tubes and/or a twist element, it is also possible to attach spinning devices, for example, to circular knitting machines with needle cylinders of small diameter, in which there would not be sufficient space at a short distance from the needle cylinder periphery to provide a spinning device for each knitting location.

If a twist element is provided, then a twist can be generated in a sliver, so that a securely transportable intermediate yarn is obtained. The twist unravels again on the way between the twist element and the stitch-forming location, so that the knitted goods are formed with a sliver with fibres lying parallel, which results in the desired soft feel of the knitted product.

A machine according to the invention can be configured as a circular knitting machine, a flat knitting machine, a hosiery machine or a raschel machine.

It is preferably a circular knitting machine with a rotary drivable needle cylinder and a plurality of stitch-forming locations, wherein each stitch-forming location has an associated spinning device. In such a machine the rotational speed of the needle cylinder can be adjustable in a manner known per se. It can additionally have an individual needle selection. Moreover, if a dial is provided on the machine, then single- or double-faced knits can be produced.

The invention additionally relates to a method for the production of knitted goods with a pattern, which is generated by forming stitches with a different sliver or yarn thickness, on a machine for the production of knitted goods with a plurality of stitch-forming elements and with at least one stitch-forming location, which has an associated spinning device, which from a roving yarn produces a sliver or a yarn and feeds this to the stitch-forming elements, wherein the spinning device has drive devices, which is characterised in that the drive devices of the spinning device or spinning devices are actuated in such a manner that a constant adjustment of the speed of the spinning devices is conducted in accordance with the desired thickness of the sliver or yarn for each stitch-forming element depending on the pattern to be generated in the knitted goods.

According to this method the thickness of the sliver or yarn can be adjusted down to the exact stitch. As a result, all conceivable patterns based on the variation of sliver or yarn thickness can be produced in a knitted product.

In this case, the speeds of the spinning devices can be changed in any desired time frame to obtain a specific pattern. The speed changes can be repeated at regular intervals in order to generate regular patterns such as undulations, stripes or horizontal stripe patterns. The time intervals, in which the speeds assume a particular value, can be selected to be always the same or varied regularly or irregularly.

The transitions between areas of the knitted goods that are generated with different sliver or yarn thicknesses can be structured in a different way. Thus, the speeds can be changed abruptly if the pattern is to have hard transitions between the areas of different sliver or yarn thickness.

However, if the speeds are adjusted in a ramp-like manner or asymptotically to a new value, then the pattern has soft transitions between areas of different sliver or yarn thickness.

To be able to produce each stitch with a defined sliver or yarn thickness, the speed of the spinning devices can be adjusted expediently to a new value at least until the spinning device has generated sufficient sliver or yarn length to form a stitch in the new thickness by means of a stitch-forming element.

In this case, after the sliver or yarn length sufficient for a stitch has been generated, the speed of the spinning device can already be adjusted to a new value again if the pattern requires that the next stitch must have another yarn or sliver thickness.

However, it is also possible to change the speeds of the spinning devices randomly in each stitch row, as a result of which knitted goods with unique patterns can be generated.

For this, a roving yarn of the same thickness can preferably be fed to each spinning device. However, it is also possible to supply some spinning devices with roving yarns of differing thickness and thus generate slivers or yarns with another thickness. Moreover, the two effects, i.e. variation of the speeds of the spinning devices and use of roving yarns of different thicknesses, can also be combined with one another.

The speed of the spinning devices can also be varied in a different manner depending on their configuration. Thus, the speed of the spinning devices can be varied, for example, by varying the relative speed of roller pairs of drafting devices, in the case where the spinning devices have drafting devices. For this, a roller pair is preferably operated at a constant speed and only the speed of the other roller pair varies.

However, the speed of spinning devices configured as friction spinning devices can be varied by varying the relative speed between the feed roller and the withdrawal roller pair.

The invention additionally relates to knitted goods, which are produced using a method according to the invention and which have a pattern that is generated by forming stitches with a different sliver or yarn thickness, wherein the pattern is formed by varying the sliver or yarn thickness in stitch row direction and/or in needle wale direction.

In this case, the knitted goods can be provided with a pattern, which has hard and/or soft transitions between stitch areas formed with different sliver or yarn thickness.

The patterns can vary in yarn or sliver thickness from stitch to stitch. The outer contours of the different stitch areas can assume any desired form. Geometric forms such as horizontal stripes, stripes or circles are conceivable. Lettering or logos can also be depicted with such stitch areas. Moreover, pattern effects only possible previously using flake yarns can be obtained.

BRIEF DESCRIPTION OF THE DRAWINGS

A preferred embodiment of a machine according to the invention as well as knitted goods according to the invention will be described in more detail below with reference to the drawing figures.

DETAILED DESCRIPTION OF THE INVENTION

Figure 1:
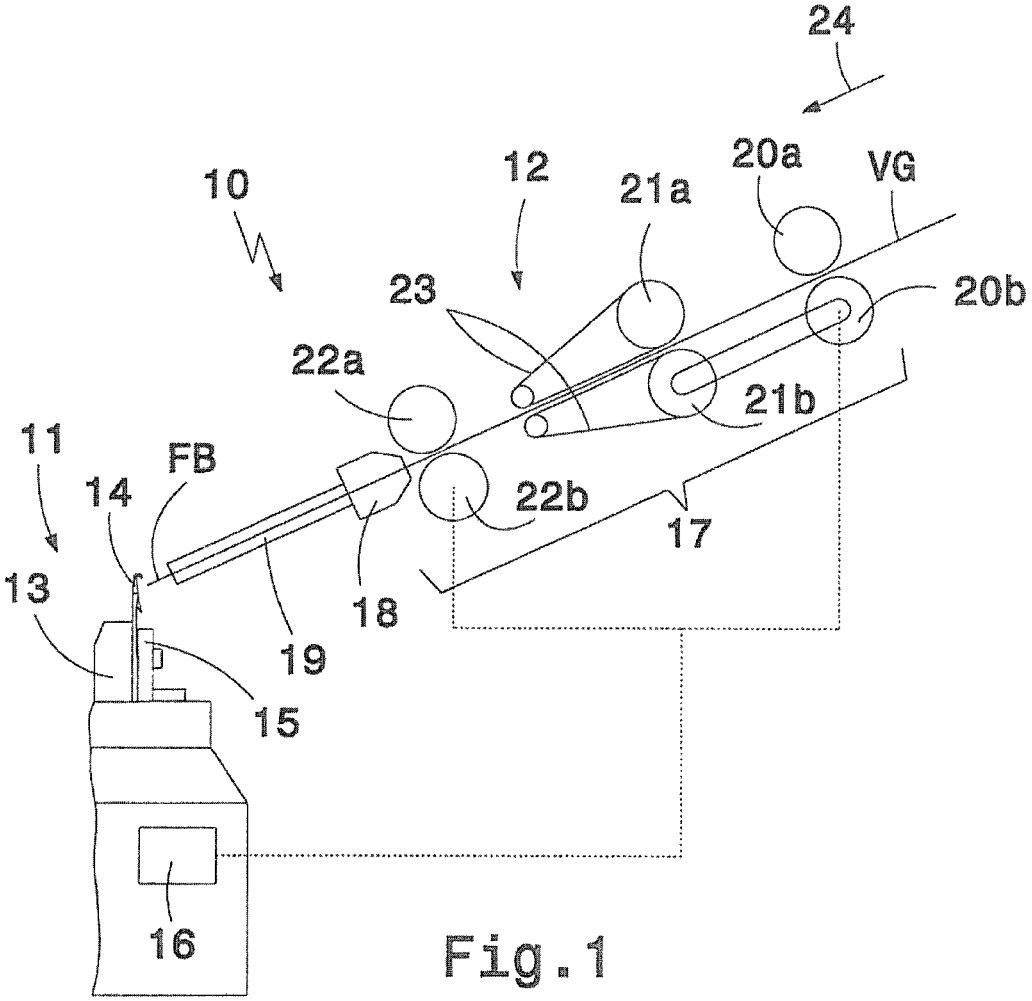
FIG. 1 is a schematic view of a circular knitting machine with first drafting devices.

In a schematic elementary drawing FIG. 1 shows a machine 10 for the production of knitted goods formed by a circular knitting machine 11 and spinning devices 12. Of the circular knitting machine 11 the drawing shows a needle cylinder 13, which is fitted with stitch-forming elements 14—in the form of latch needles here—, and a stitch-forming location 15, at which the stitch-forming elements 14 can be raised for stitch formation. A control device 16 for the entire machine 10 is also indicated.

The stitch-forming location 15 is assigned the spinning device 12, which comprises a drafting device 17 and a twist element 18, wherein the twist element 18 is connected to a transport tube 19. The drafting device 17 has a feed roller pair 20*a*, 20*b*, an apron roller pair 21*a*, 21*b* and a withdrawal roller pair 22*a*, 22*b*. Double aprons 23 are guided over the apron roller pair 21*a*, 21*b*. The respective bottom roller 20*b*, 21*b* and 22*b* is driven in each of the roller pairs 20*a,b* to 22*a,b*. The drive devices (not shown in more detail here) of the bottom rollers 20*b* and 22*b* are connected to the control device 16 and can therefore be actuated by this. Bottom roller 21*b* is mechanically coupled to bottom roller 20*b* and therefore rotates at a circumferential speed that stands in a fixed ratio to the circumferential speed of bottom roller 20*b*.

A roving yarn VG, which is aimed by a flyer frame sliver with a certain twist, is fed to the drafting device 12 in the direction of arrow 24. Because of the twist the roving yarn VG has sufficient strength to allow it to be wound onto bobbins and also fed to the drafting device 12 over longer distances. However, the twist must unravel again in the drafting device so that the roving yarn VG can be drawn to the desired yarn count. The unravelling of the twist occurs in a predrafting zone of the drafting device 12, which extends between the feed roller pair 20*a,b* and the apron roller pair 21*a,b*. However, the main drafting zone extends between the apron roller pair 21*a,b* and the withdrawal roller pair 22*a,b*. The thickness of the sliver FB generated by the drafting device 12 is determined by the difference in the circumferential speeds of the roller pairs 21*a,b* and 22*a,b*. These circumferential speeds can be adjusted by the control device 16 in such a manner that a sliver FB in the desired thickness can be fed to each stitch-forming element 14. This enables a knitted product to be knitted by the circular knitting machine 11 that is provided with a pattern formed by areas of different sliver or yarn thicknesses, wherein such different areas can also be provided within a stitch row. With correspondingly short lengths of the drafting zones of the drafting device 12 and a relatively coarse gauge of the machine 11 a sliver FB or yarn of different thickness can even be fed to each stitch in this case. As a result, patterns in which each stitch has a different thickness, at least in areas, can even be generated.

The sliver FB exiting from the drafting device 12 is given a false twist by the twist element 18, as a result of which it can be fed in a stable manner through the transport tube 19 to the stitch-forming elements 14. The false twist unravels again as the sliver FB passes through the transport tube, so that a sliver FB with substantially parallel oriented fibres can be knitted by the stitch-forming elements 14. A twist element 18 and a transport tube 19 can also become unnecessary if the drafting device 12 is arranged very close to the stitch-forming location 15.

Figure 2:
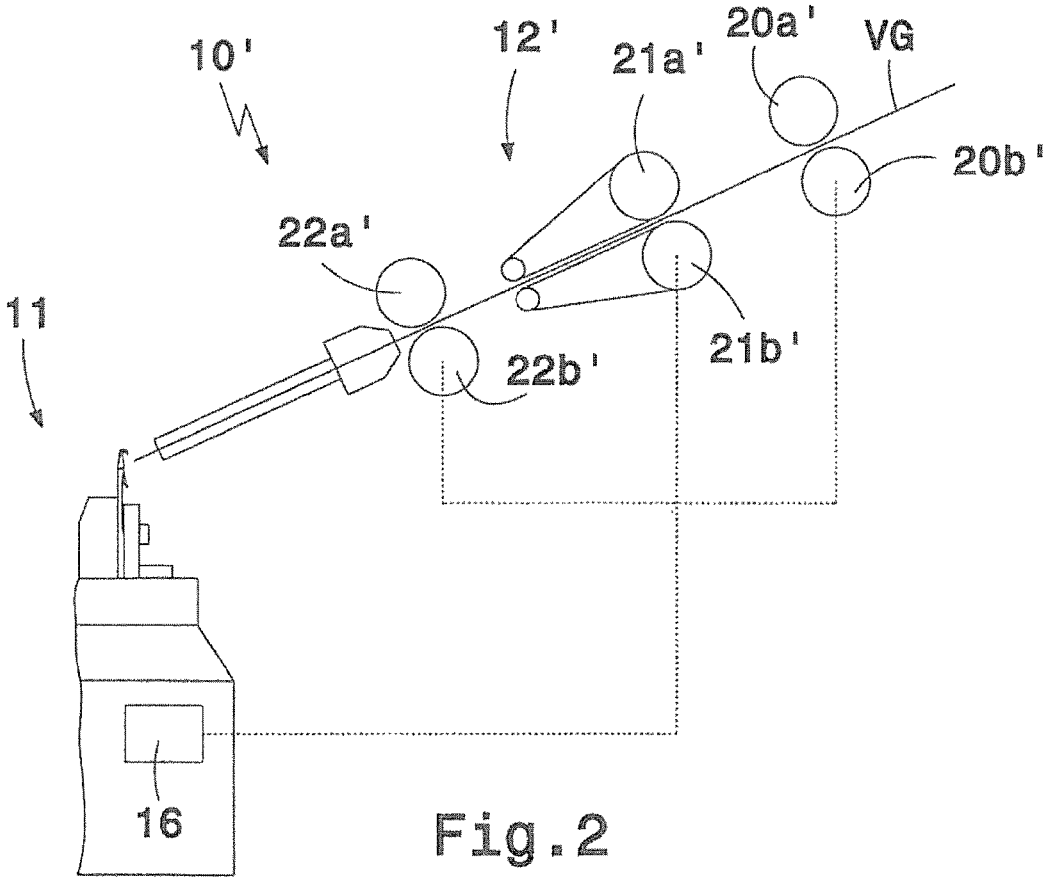
FIG. 2 is a schematic view of a circular knitting machine with second drafting devices.

The machine 10' evident from FIG. 2 again has a circular knitting machine 11. In addition, a drafting device 12' is provided which is very similar in structure to the drafting device 12 from FIG. 1 and only differs from this in that all the bottom rollers 20*b*', 21*b*' and 22*b*' of the roller pairs 20*a*', 20*b*'; 21*a*', 21*b*' and 22*a*', 22*b*' have their own drive devices and can be actuated individually and independently of one another by the control device 16 of the machine 10'. As a result, the predrafting of the roving yarn VG can now also be varied by changing the ratio of the circumferential speeds of rollers 20*b*' and 21*b*' to one another. The achievable thickness range of the roving yarn FB can be increased further as a result.

Figure 3:
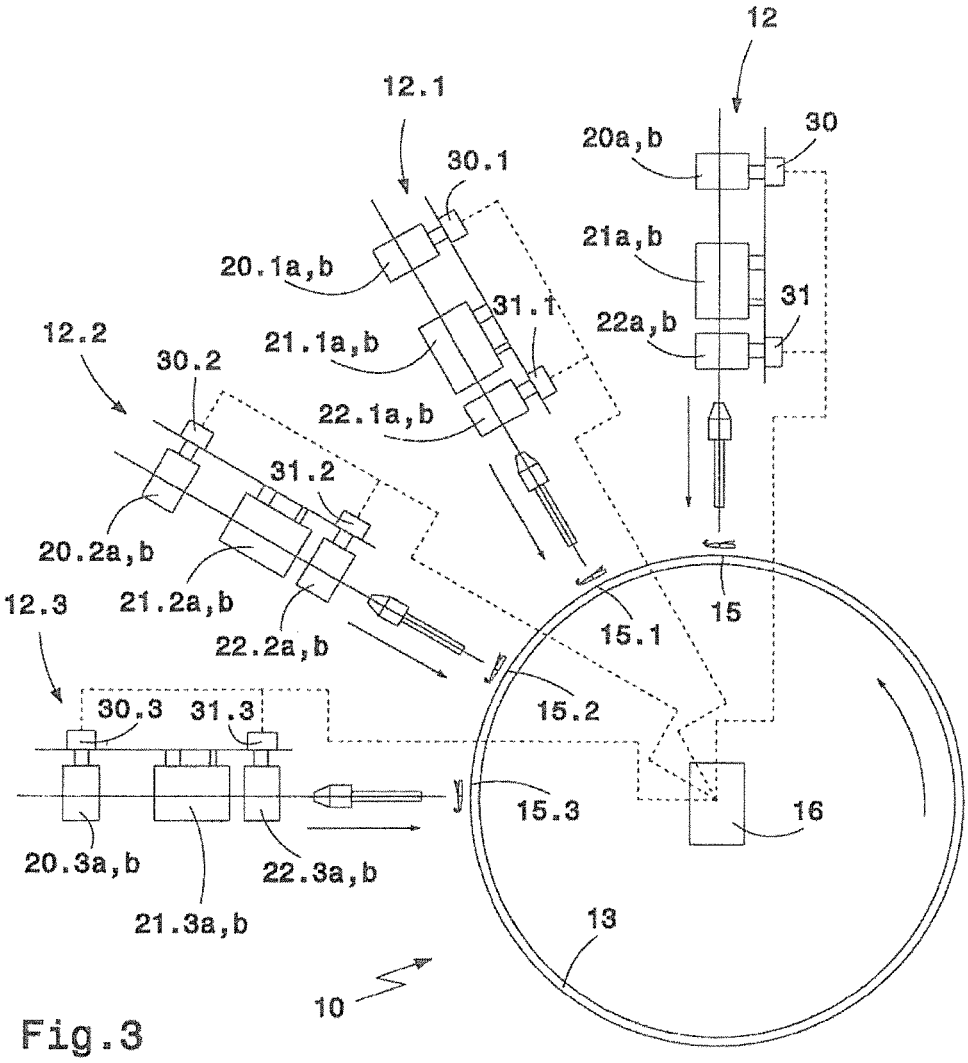
FIG. 3 is a plan view onto the circular knitting machine from FIG. 1.

FIG. 3 is a plan view onto the machine 10 from FIG. 1. It may be seen that multiple stitch-forming locations 15, 15.1, 15.2, 15.3 distributed over the circumference are provided on the needle cylinder 13 of the circular knitting machine 11, and only four of these are shown for reasons of clarity. Each stitch-forming location 15, 15.1, 15.2, 15.3 has an associated drafting device 12, 12.1, 12.2, 12.3, wherein these are identical in structure and have respective feed roller pairs 20*a,b*, 20.1*a,b*, 20.2*a,b*, 20.3*a,b*, apron roller pairs 21*a,b*, 21.1*a,b*, 21.2*a,b*, 21.3*a,b* and withdrawal roller pairs 22*a,b*, 22.1*a,b*, 22.2*a,b*, 22.3*a,b*. Each feed roller 20*h*, 20.1*b*, 20.2*b*, 20.3*b* has a respective associated drive device 30, 30.1, 30.2, 30.3. The withdrawal rollers 22*b*, 22.1*b*, 22.2*b*, 22.3*b* also have drive devices 31, 31.1, 31.2, 31.3. All the drive devices 30. 30.1, 30.2, 30.3, 31, 31.1, 31.2, 31.3, which can preferably be configured as electric motors, are connected to the control device 16 and can respectively be actuated by this completely independently of each of the other drive devices 30. 30.1, 30.2, 30.3, 31, 31.1, 31.2, 31.3. As a result, it is possible to produce a sliver of a different thickness with each of the drafting devices 12, 12.1, 12.2, 12.3 and feed it to the associated stitch-forming location 15, 15.1, 15.2, 15.3. Thus, knitted goods can be produced with a pattern in which the yarn thickness changes multiple times within a stitch row.

Figure 4:
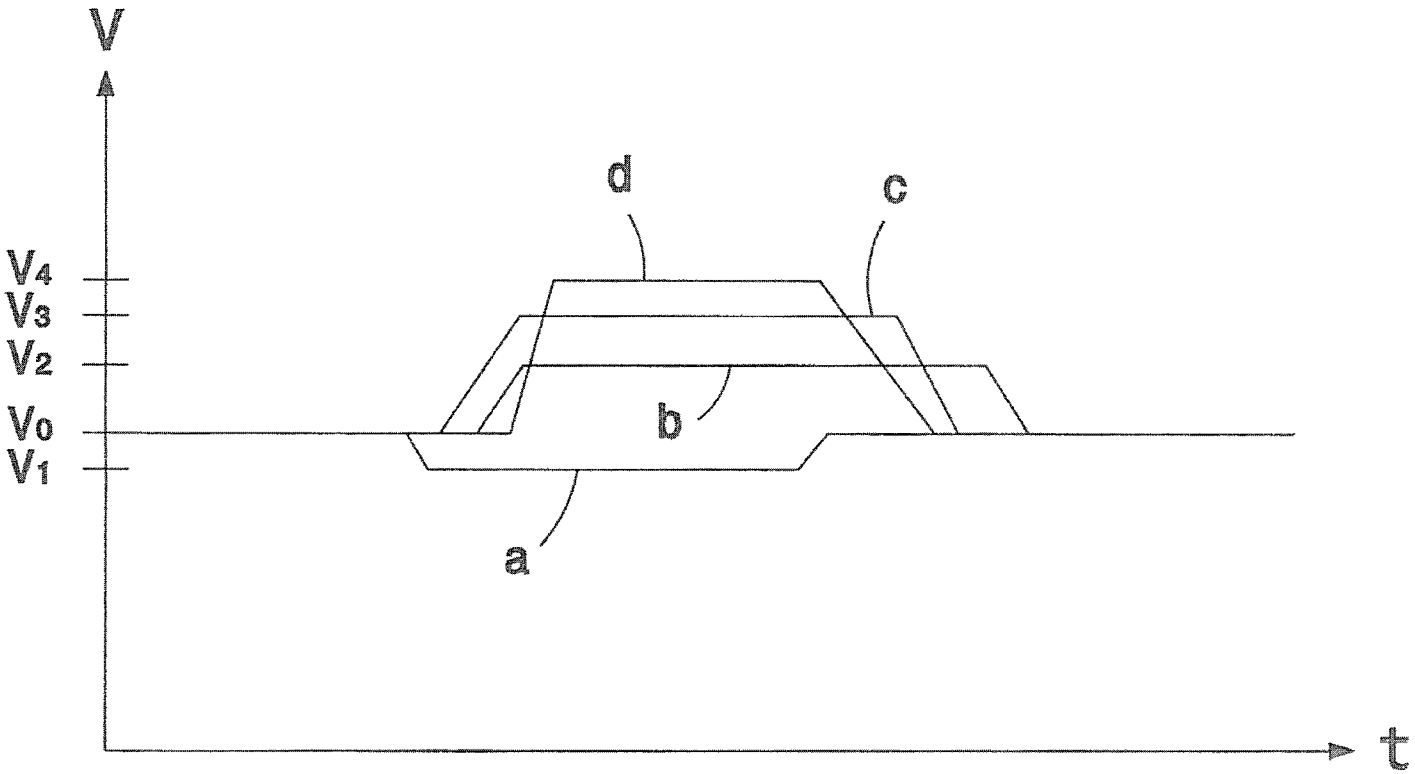
FIG. 4 is a diagram with different speed profiles of the drafting device drives of the circular knitting machine from FIG. 1.

FIG. 4 is a schematic diagram of some possible time curves of the drafting speed V of a drafting device 12, which is defined as relative speed between the apron roller pair 21*a,b* and the withdrawal roller pair 22*a,b*.

In curve a the speed V is adjusted from a base speed V0 to a lower value V1 for a specific time interval and then back to value V0. During the time interval, in which the speed V assumes the value V1, a thicker sliver FB is generated by the drafting device and fed to the stitch-forming elements than in the time periods, in which the value amounts to V0. The transitions between values V0 and V1 are respectively ramp-like and relatively steep, as a result of which the pattern area knitted with the thicker sliver has sharp edges on both sides.

Curves b, c and d show a periodic increase in speed V from value V0 to higher values V2, V3, V4. The time intervals, in which the speed V assumes the respective higher value, differ from curve to curve, as does the start time of the speed increase. However, each of the curves leads to pattern areas, in which stitches are formed with a finer yarn or sliver. These areas are sharply defined on both sides in the case of curves b and c. However, in curve d the speed is rapidly increased from value V0 to value V4, but is then decreased relatively slowly again. As a result, the stitch ara, which is knitted with a lower yarn count, is given a sharp edge on one side and a gradual transition to the stitch area in the base count on the other side.

The represented curves of the drafting speed V are merely exemplary. In principle, the speed can vary within a permissible amplitude range in any desired time period. The permissible amplitude range is dependent on the roving yarn used and also the drafting device properties. The produced sliver must be sufficiently thin to enable it to be processed by the stitch-forming elements, but must also be thick enough to have the necessary stability.

Figure 5:
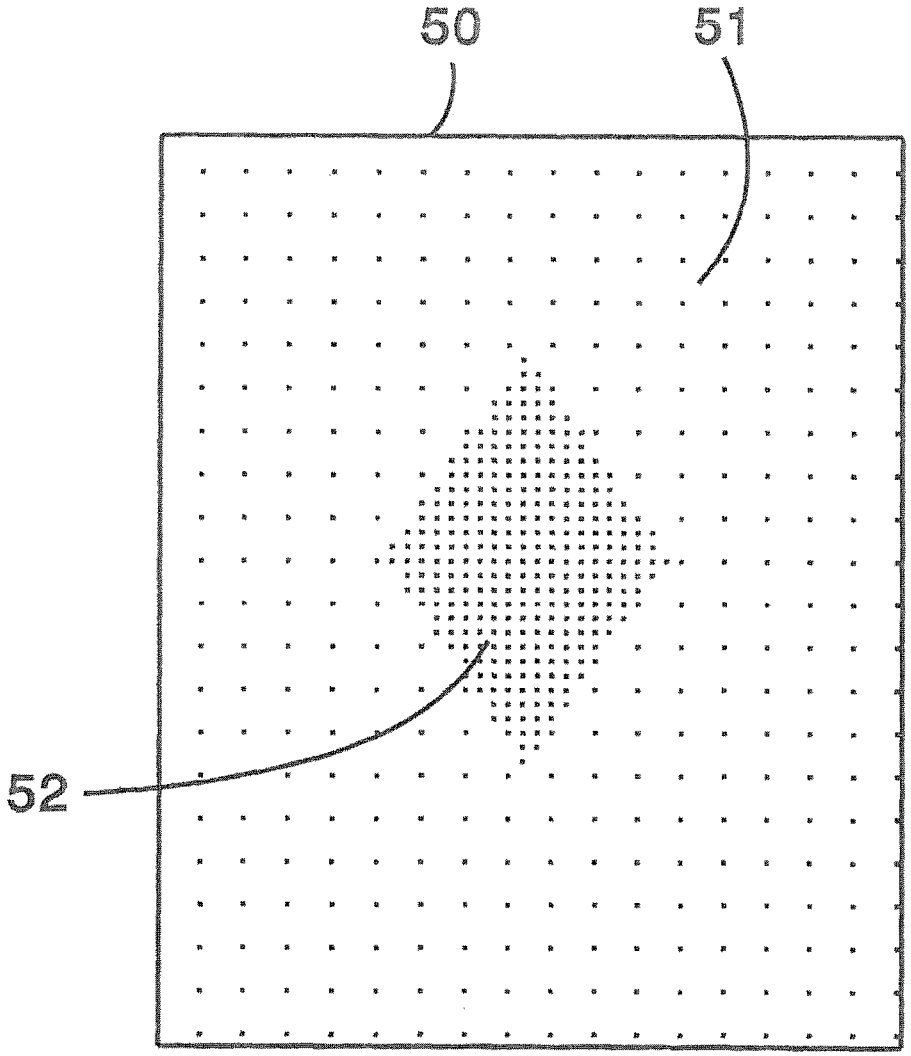
FIG. 5 is a schematic representation of a first knitted product with stitch areas that are produced with different sliver thicknesses.
Figure 6:
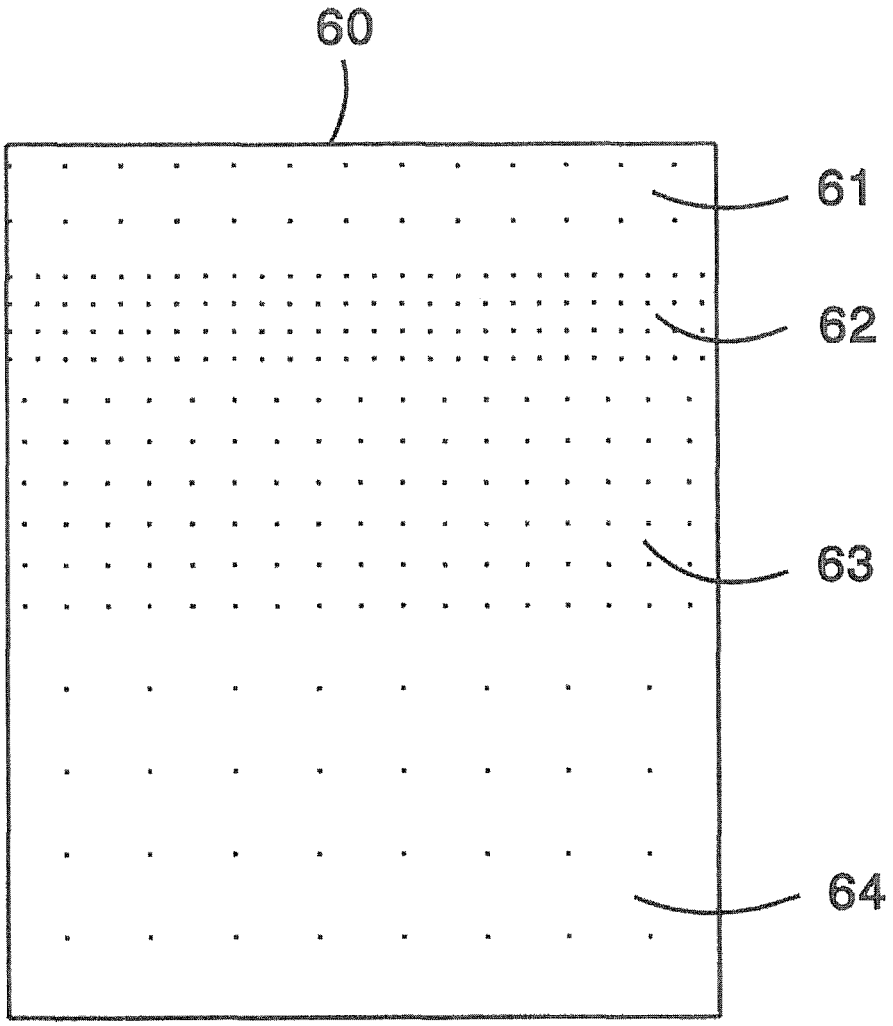
FIG. 6 is a schematic representation of a second knitted product with stitch areas that are produced with different sliver thicknesses.
Figure 7:
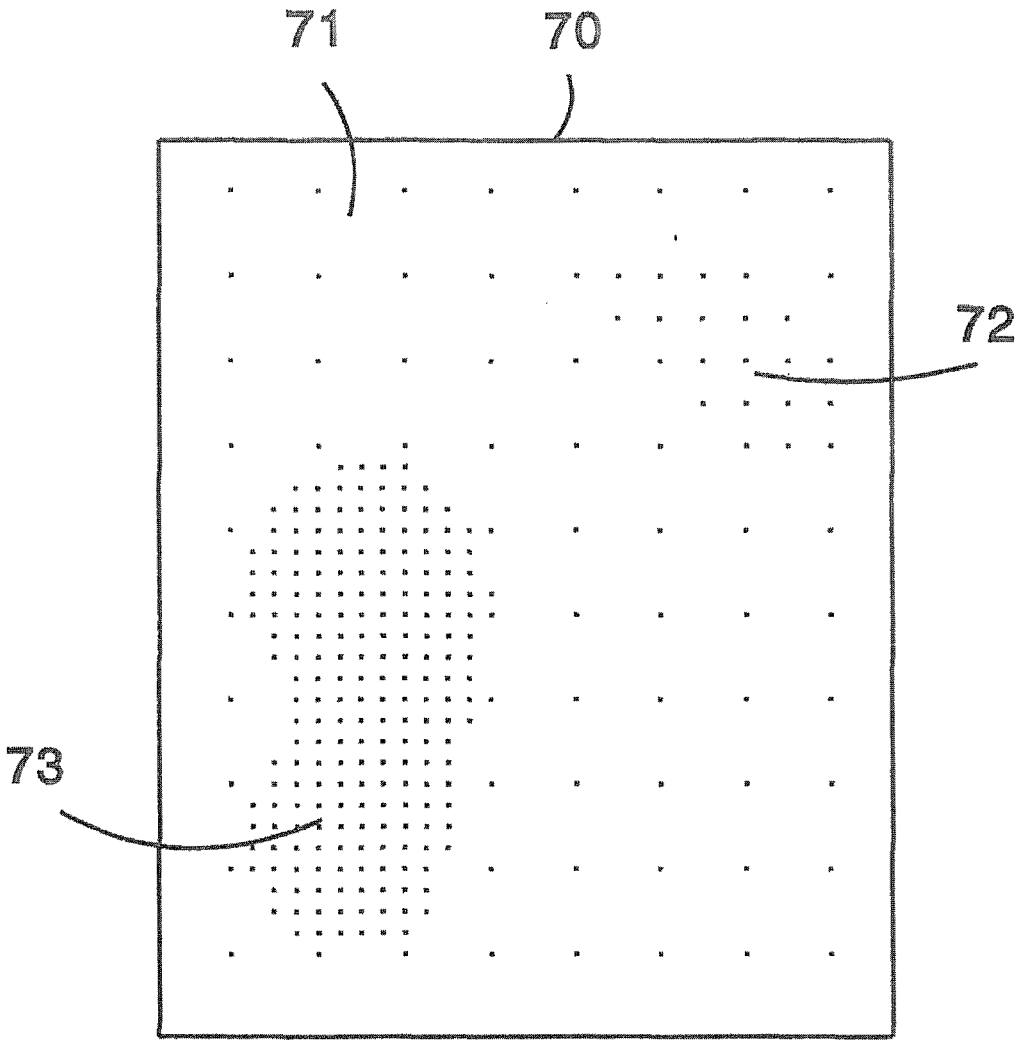
FIG. 7 is a schematic representation of a third knitted product with stitch areas that are produced with different sliver thicknesses.

FIGS. 5 to 7 show three examples of sections of knitted goods according to the invention, which are respectively provided with patterns formed by specific stitch areas being knitted with a different sliver or yarn thickness. In FIGS. 3 to 5 those areas that are characterised by closely arranged dots are stitch areas that have been knitted with a thicker sliver or yarn.

The knitted product 50 from FIG. 5 has a base knit 51 that was produced with a uniform sliver or yarn thickness. There is a diamond-shaped area 52 provided within this base knit 51 that was produced with a greater sliver or yarn thickness. The area 52 has sharp outer contours in this case.

In contrast, the knitted product 60 from FIG. 6 has a pattern that is formed by four stripes 61-64 overall, which were all produced with yarns or slivers of different thickness.

The knitted product shown in FIG. 7 has a base knit 71 with two irregular cloud-shaped stitch areas 72 and 73 that are respectively produced in different yarn or sliver thicknesses. As in the case of area 52 of the knitted product 50 from FIG. 5, variations in the sliver or yarn thickness both in stitch row direction and in needle wale direction are necessary to knit areas 72 and 73.

It is understood that in the case of machines 10 and 10' the drafting devices 12 or 12' could also be replaced by other spinning devices such as friction spinning devices. Yarns of different thickness can also be produced by regulating the spinning speed with these machines. The circular knitting machine 11 could also be replaced by a flat knitting machine, a hosiery knitting machine or a raschel machine.

What is claimed is:

1. A machine for the production of knitted goods, comprising:

a plurality of stitch-forming elements;

at least one stitch-forming location; and an associated spinning device positioned at a stitch-forming location;

wherein the associated spinning device processes a roving yarn (VG) to produce a sliver (FB) or a yarn and feeds the sliver (FB) or the yarn to the stitch-forming elements;

wherein each said associated spinning device has drive devices that are actuated in said associated spinning device to produce the sliver (FB) or the yarn with a variable thickness from the roving yarn (VG); and wherein the sliver (FB) or the yarn that is produced with the variable thickness is fed to the stitch-forming elements.

2. The machine according to claim 1, wherein two spinning devices are provided at two respective stitch-forming locations, wherein the variable thickness of the sliver (FB) or the yarn produced by the respective two spinning devices can be different.

3. The machine according to claim 1, wherein the drive devices are actuated such that the variable thickness of the sliver (FB) or the yarn varies between the stitch-forming elements supplied by a same spinning device.

4. The machine according to claim 1, wherein the drive devices are actuated such that the variable thickness of the sliver (FB) or the yarn produced is different in all the stitch-forming elements supplied by a same spinning device.

5. The machine according to claim 1, wherein the at least one spinning device includes drafting devices with multiple roller pairs, wherein at least two of the roller pairs have an associated drive device and wherein each associated drive of the at least two roller pairs are actuated independently of one another.

6. The machine according to claim 5, wherein the spinning devices are provided with multiple drafting devices arranged next to one another.

7. The machine according to claim 1, wherein the spinning device includes friction spinning devices with at least one feed roller, the speed of which is adjustable in relation to a roller pair.

8. The machine according to claim 1, wherein transport devices for the sliver (FB) or the yarn produced are provided between the spinning devices and the stitch-forming elements.

9. The machine according to claim 8, wherein the the transport devices comprise at least one of transport rollers, transport tubes and a twist element.

10. The machine according to claim 1, configured as any of a circular knitting machine, a flat knitting machine, a hosiery machine or a raschel machine.

11. The machine according to claim 1, configured as a circular knitting machine and further comprising a rotary drivable needle cylinder, a plurality of stitch-forming locations and an associated spinning device at each of the plurality of stitch-forming locations.

12. The machine according to claim 11, wherein a rotational speed of the needle cylinder is adjustable.

13. The method according to claim 1, wherein the speed (V) of the spinning device is adjusted to a new speed (V) that is maintained at least until the spinning device has generated sufficient sliver (FB) or yarn length to form a stitch in a new thickness by the respective stitch-forming element.

14. The method according to claim 13, wherein after an amount of the sliver (FB) or yarn length sufficient for a stitch has been generated, the speed (V) of the spinning device can be adjusted to a new speed (V).

15. A method for producing knitted goods with a pattern formed in reliance upon stitches formed with different sliver (FB) or yarn thickness, using a knitting machine comprising a plurality of stitch-forming elements, at least one stitch-forming location and an associated spinning device at the at least one stitch-forming location, wherein the associated spinning device is configured with drive devices, and wherein the method comprises the steps of:

producing the sliver (FB) or the yarn from a roving yarn (VG), using the associated spinning device;

feeding the sliver (FB) or the yarn to the stitch-forming elements to form stitches with the different sliver (FB) or yarn thickness;

wherein the step of producing includes actuating the associated spinning device to control or adjust a speed (V) of the associated spinning device in accordance with a desired thickness of the sliver (FB) or yarn fed to each stitch-forming element, of the stitch-forming elements, depending on the pattern to be formed in the knitted goods.

16. The method according to claim 15, wherein the speed (V) of the spinning device in any time period to obtain the pattern.

17. The method according to claim 15, wherein the speed (V) of the spinning device is changed abruptly if the pattern is to have hard transitions between areas of different sliver (FB) or yarn thickness.

18. The method according to claim 15, wherein the speed (V) of the spinning device is adjusted in a ramp-like manner or asymptotically to a new speed (V), to define soft transitions between areas of different sliver (FB) or yarn thickness in the pattern.

19. The method according to claim 15, wherein a second roving yarn (VG) is fed to the spinning device.

20. The method according to claim 15, wherein the speed (V) of the spinning device is adjusted by varying a relative speed of roller pairs of the spinning device.

21. The method according to claim 20, wherein the spinning device is configured as a friction spinning device and wherein the speed (V) is varied by adjusting a relative speed between a feed roller and a withdrawal roller pair of the spinning device.

22. Knitted goods produced using the method according to claim 15, wherein the pattern is generated by forming stitches with the different sliver (FB) or yarn thickness, and varying a thickness of the sliver (FB) or yarn in stitch row direction, in needle wale direction or both.

23. The knitted goods according to claim 22, wherein pattern has hard transition, soft transitions, or both between stitch areas formed with different sliver (FB) or yarn thickness.

* * * * *